US005129854A

United States Patent [19]

Hill

[11] Patent Number: 5,129,854

[45] Date of Patent: Jul. 14, 1992

[54] ROLL OVER PUSH ROLLING TOY FOR STAIRWAYS

[76] Inventor: Joseph M. Hill, P.O. Box 3133, Gettysburg, Pa. 17325

[21] Appl. No.: 743,777

[22] Filed: Aug. 12, 1991

[51] Int. Cl.[5] ..... A63H 17/00; A63H 33/00; A63H 11/08

[52] U.S. Cl. ..... 446/465; 446/431; 446/487; 446/324

[58] Field of Search ..... 446/431, 465, 469, 462, 446/433, 437, 441, 450, 451, 452, 453, 324, 396, 487, 93, 94, 95, 96

[56] References Cited

U.S. PATENT DOCUMENTS 1,566,495 12/1925 Mallard ..... 446/451
2,693,051 11/1954 Cavanagh ..... 446/451
3,540,151 11/1970 Ishida ..... 446/462 X
4,674,585 6/1987 Barlow et al. ..... 446/462 X
4,813,906 3/1989 Matsuyama et al. ..... 446/462 X

*Primary Examiner*—Robert A. Hafer
*Assistant Examiner*—D. Neal Muir

[57] ABSTRACT

A rolling toy is created by segments which are bound together by connectors and axles. The toy has a plurality of segments including front and rear segments. The toy declines in a revolving end-to-end motion. The segments are spaced apart with a specified distance and are rotatable to each other. This rolling toy has the capability of declining down stairways and rolling on most horizontal surfaces. The toy is of an appropriate length for revolving end-to-end while declining down stairways.

2 Claims, 7 Drawing Sheets

ROLL OVER PUSH ROLLING TOY FOR STAIRWAYS

BACKGROUND OF THE INVENTION

A. Field of the Invention

The present invention relates to a rollable toy which declines downstairs and can also be used as a rolling toy on horizontal surfaces. More specifically, the toy, while moving downstairs, does a flip wherein the segment that started in the front is now the tail end. This transaction is continued down the stairs.

B. Description of Prior Art

There have been rolling toys in the past that roll on many surfaces but there has not been any rolling toy that can decline down steps while flipping end to end.

SUMMARY OF THE INVENTION

The principle object of the present invention is to provide a rolling toy that will decline down steps and rolls on horizontal surfaces.

Another object of the present invention is to provide such a device which is safe for children and of simple, inexpensive construction.

These foregoing objections can be accomplished by providing a segmented rolling toy having a plurality of segments. In the preferred embodiment of the invention, the segments have a hole going through the center in which axles are fit. The axles are extended a specified distance on both sides of the segment and are then fastened by connectors that have holes which are spaced apart a specified distance. The connectors are then fastened on the axle's extension which are on both sides of the outer walls of the segments. They are then fastened on by a clamping means that fastens the connectors to the axle. In the preferred rolling toy the connectors are rotated in the way that they are fastened to the axles. The first pair starts with the inside; the second pair outside and so on so that the last pair is as the first pair.

DETAILED DESCRIPTION

Figure 1A:
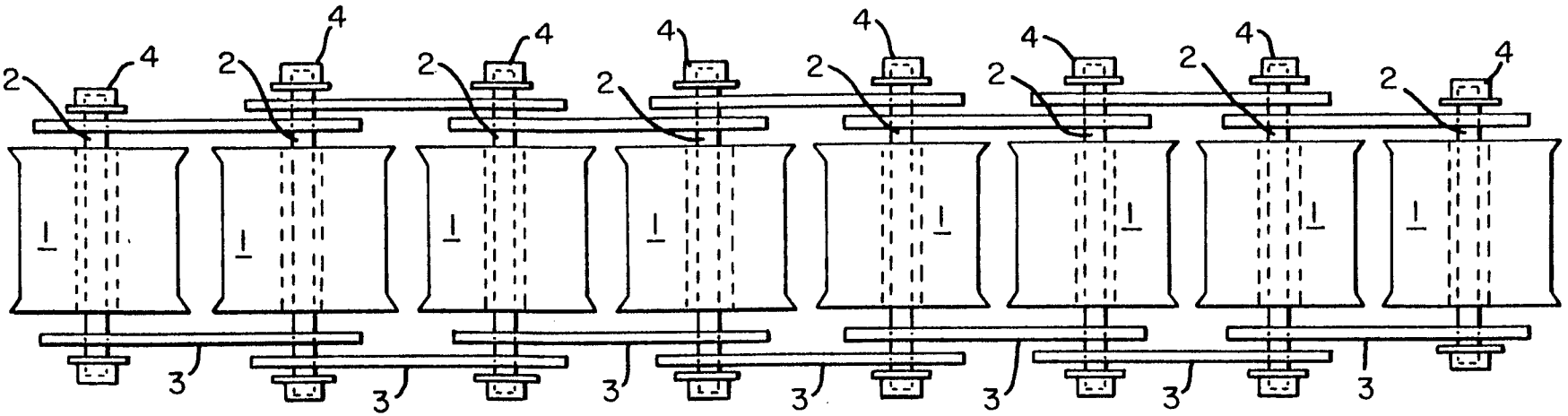
FIG. 1A is a top plan view of the preferred embodiment of this invention supported on a generally horizontal surface.
Figure 1B:
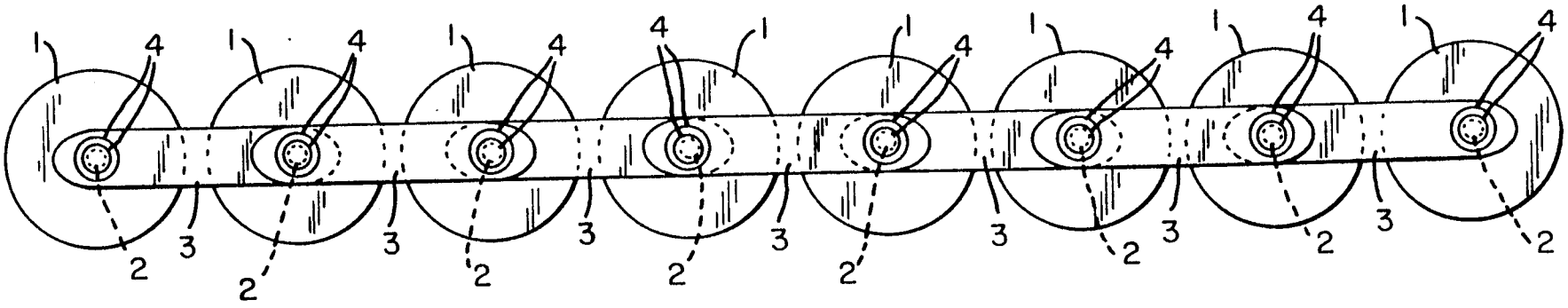
FIG. 1B is a side elevation view of FIG. 1A to clarify the manner in which it is connected.
Figure 4:
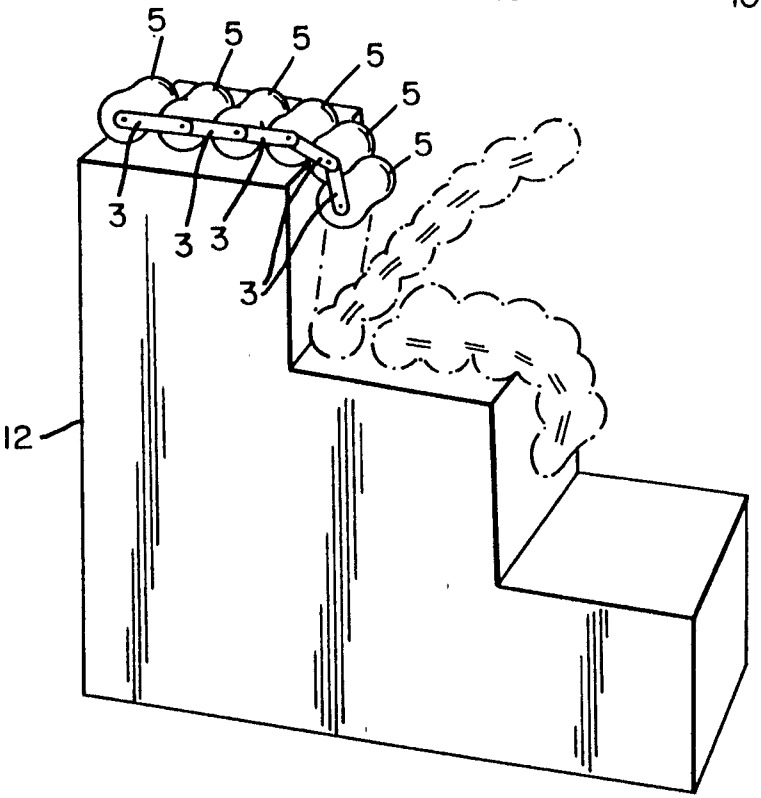
FIG. 4 is a perspective view showing how FIG. 1A,B and FIG. 2A,B in action will preferably decline down stairs.

As shown in FIG. 1A, the preferred rolling toy in accordance with the present invention includes round segments (1) which preferable is of strong molded plastic material. There is a hole going through the center of the segment in which the axle (2) will fit through and extend on both sides of the segments. The connectors (3) will be fitted onto the extended part of the axles on each side of the segment as more clarified in FIG. 1B. A clamping device (4) will be fastened on the end of the extended part of the axles to keep the connectors fastened with a little slack between the segment and clamping device. The connectors will be able to move freely around the axle. As best shown in FIG. 1A, the connectors hereinafter will preferably be rotated in the way they are fitted on the axles. The first inside, then the second pair outside, to allow accuracy in rolling. It has been found that the smallest amount of distance between each segment, while they are still not touching, is best. It has also been found, that by taking the average dimensions of steps, the preferably length of the toy should be approximately 12 inches in length. Otherwise, the preferable invention may not be of the proper length to work correctly. As shown in FIG. 4, the length is very important because there should be enough of the toy going over the edge of the step (12) so that it will pull the toy down to the following step causing the end to flip to the front. This continues down to the last step as shown in FIG. 4.

Figure 2A:
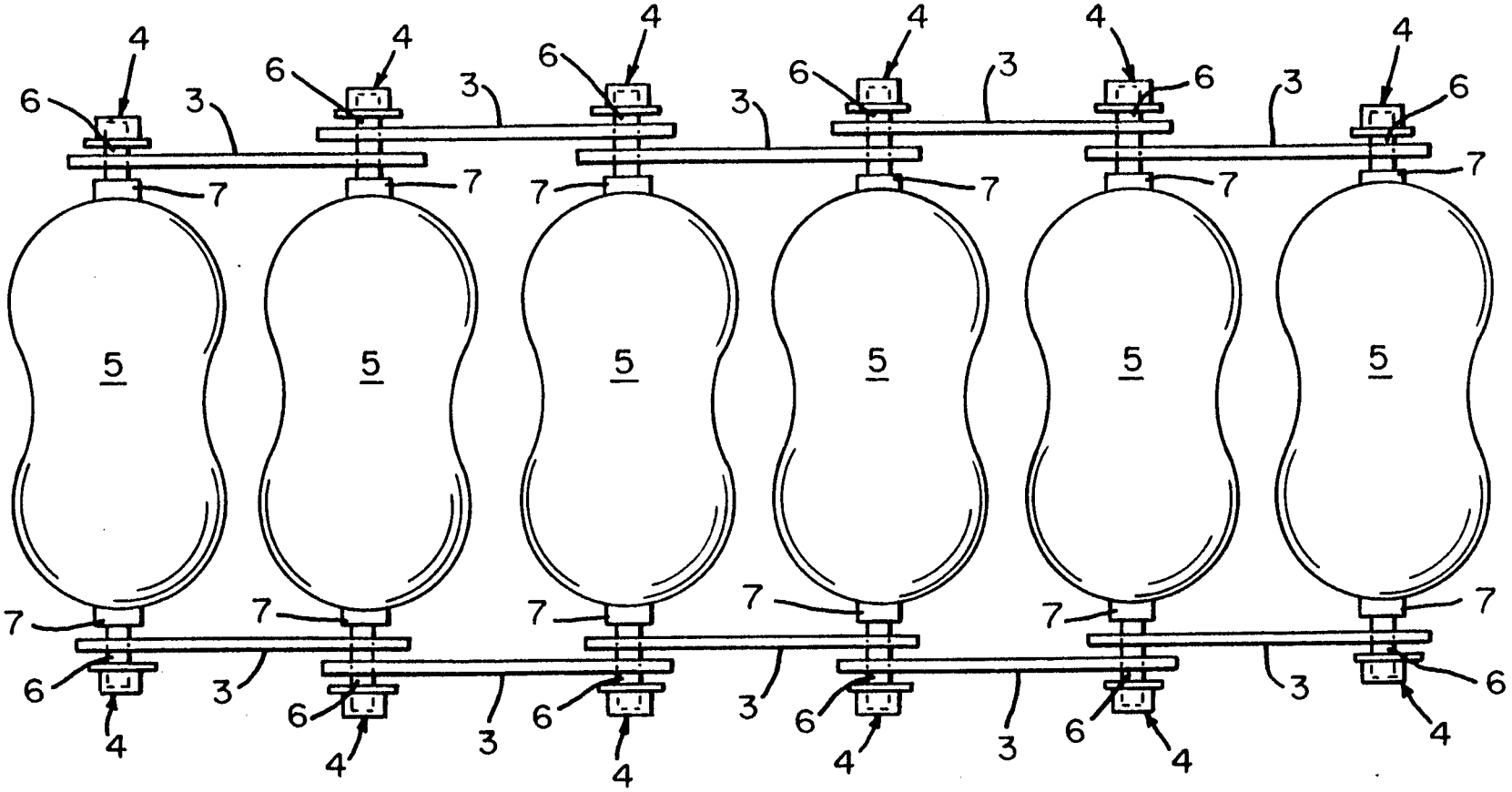
FIG. 2A is a top plan view of another variation which is supported on a generally horizontal surface.
Figure 2B:
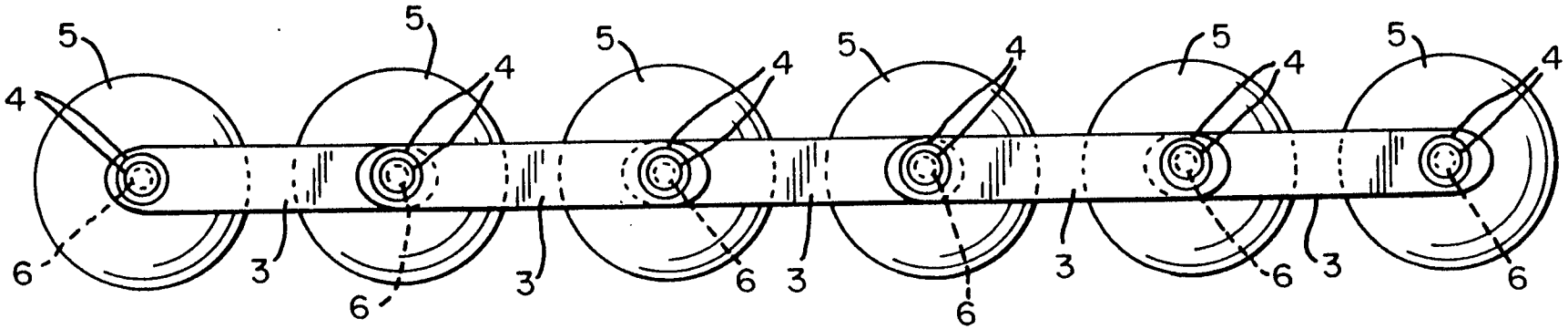
FIG. 2B is a side elevation view of FIG. 2A to clarify the fastening of the axles and connectors.

Another embodiment of this invention is similar to FIG. 1A,B, except that in FIG. 2A each segment (5) has no hole through its center, but rather two equal spacers (7) of a specified length and width protruding on the opposite centers of both sides of the segments (5). An axle (6) on each segment is protruding from the spacer's (7) center which is smaller in diameter with a specified distance and width protruding. These segments are then fitted together by connectors (3). Then they are fastened by a clamping means (4) that keep the connectors fastened to the segments with enough slack to allow mobility. This is clarified better in FIG. 2B. This variation is preferably used on stairways. As shown in FIG. 4, it works in the same manner as FIG. 1 but its construction is more efficient.

Figure 3A:
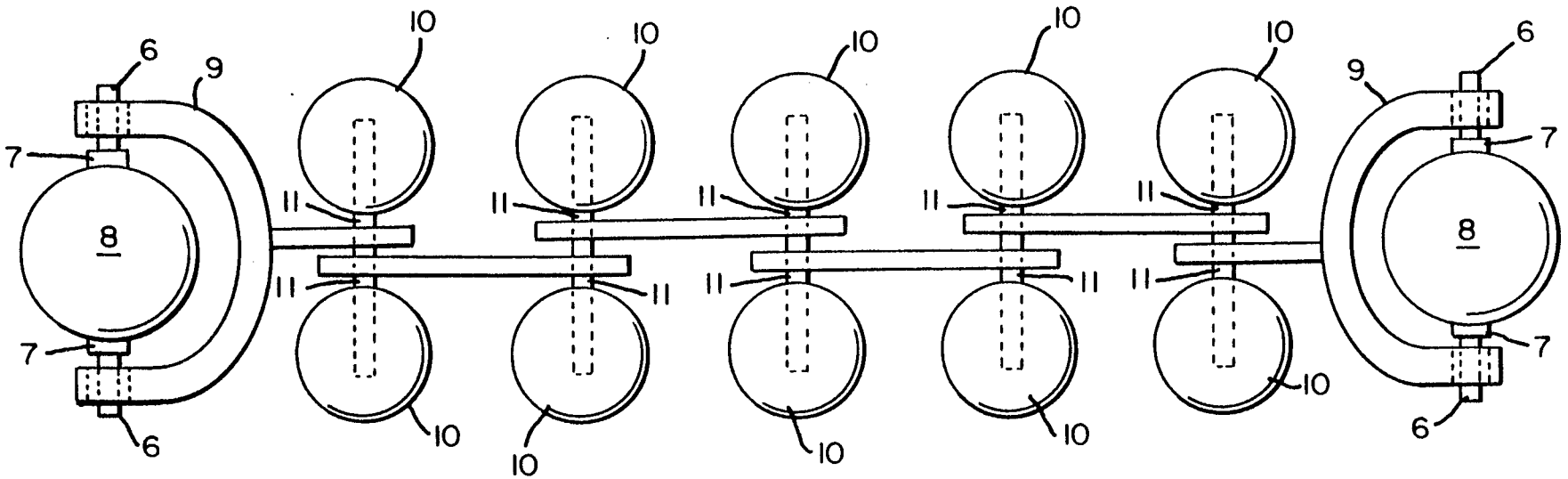
FIG. 3A is a top plan view of another variation of this invention supported on a generally horizontal surface.
Figure 3B:
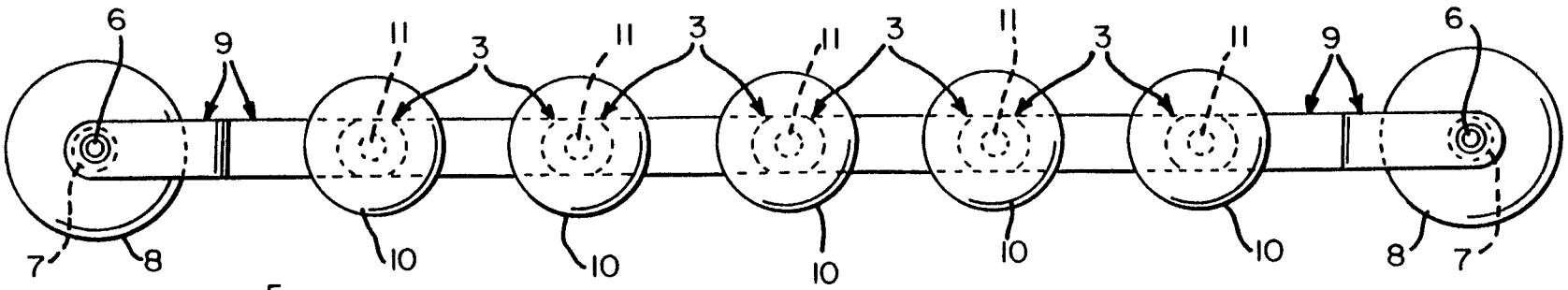
FIG. 3B is a side elevation view of FIG. 3A to clarify the connection of the segments.
Figure 5:
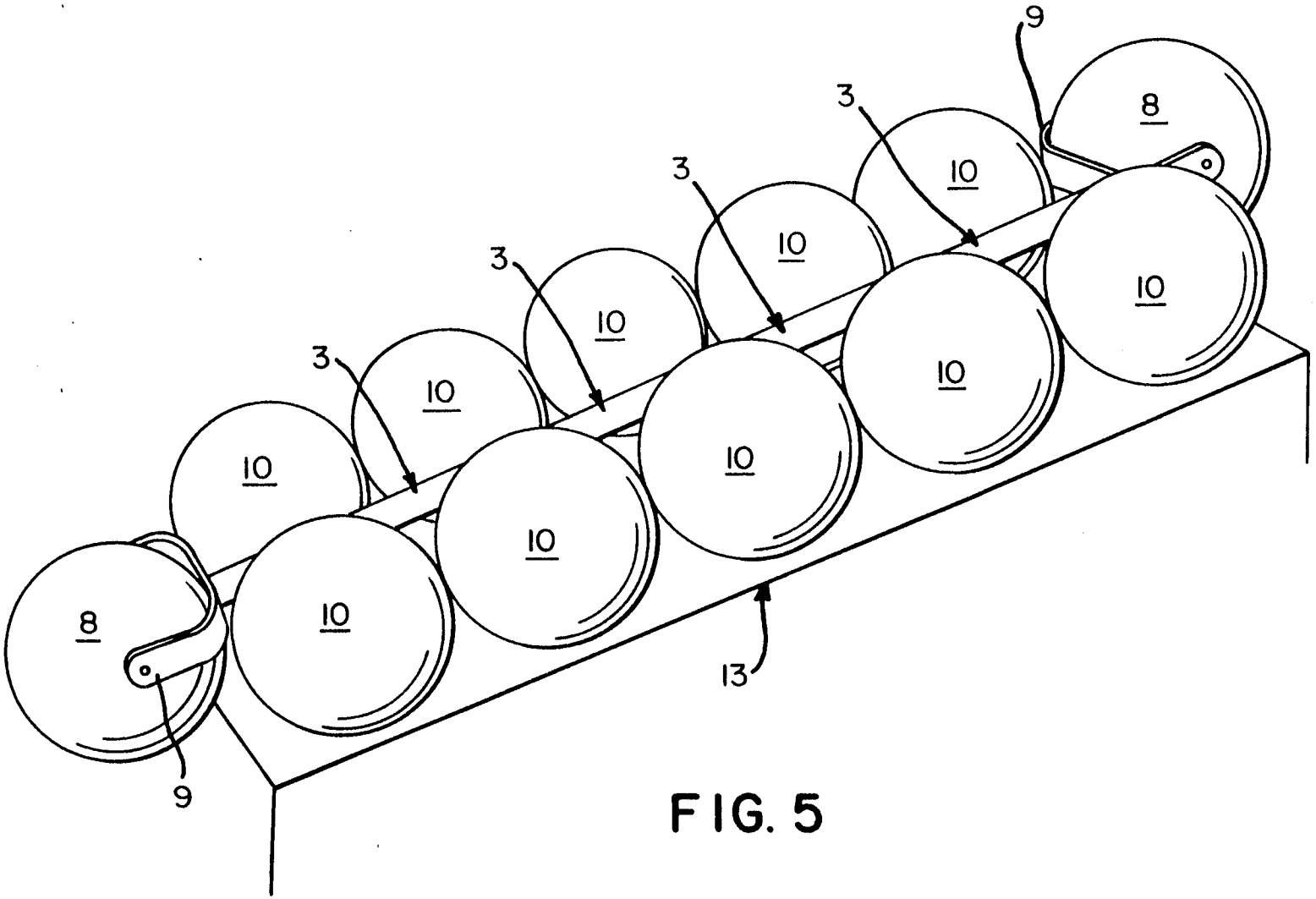
FIG. 5 is a perspective view showing FIG. 3A,B on a rollable surface.

In FIG. 3A,B, the third variation, rollable-shaped segments (8) are connected at each end with a connector (9). The end segments have two spacers (7) that are protruding from the opposite centers of the end segments. An axle (6) is protruding from each spacer (7) and is a specified distance width. The body segments (10) are between the end segments which are rollable and fastened by an axle (11) that is in the center of the rollable body segments (10) and are connected in the center of the body segments by connectors (3). This is clarified in FIG. 3B. Each segment is fastened with connectors with intermesh and overlap at their shared axle so that the adjacent units rotate in relation to one another. This variation will preferable be used on most horizontal surfaces (13) as shown in FIG. 5.

The foregoing description of the preferred embodiment of the invention has been shown for the purposes of illustration and description. It is not meant to be exhaustive or to limit the invention to the precise form given. Many modifications and variations are possible in view of the above presentation. It is intended that the field of the invention be limited not by this detailed description, but rather by the claims amended hereto.

I claim:

1. A rollover push toy comprising a plurality of roller segments, each segment having a central longitudinal axis, each segment comprising an axle supporting said segment at the axis, each axle extending beyond the roller segment along the axis, each axle extension engaging connectors, each connector linking a segment to an adjacent segment allowing pivotal movement between connectors and segments, each axle comprising a clamping means retaining said connectors yet allowing angular displacement between adjacent connectors, the toy being sized to roll down a stairway rolling over each time the leading segment falls to the step below thereby reversing that segment leading the toy as it proceeds down a set of steps.

2. A rollover push toy comprising a plurality of roller segments, each segment having a central longitudinal axis, each segment comprising at least two rollers, each segment comprising an axle supporting said segment at the axis, each axle extending between the roller segments along the axis, each axle extension engaging connectors, each connector linking a segment to an adjacent segment allowing pivotal movement between connectors and segments, each axle comprising a clamping means retaining said connectors yet allowing angular displacement between adjacent connectors, the toy being sized to roll down a stairway rolling over each time the leading segment falls to the step below thereby reversing that segment leading the toy as it proceeds down a step of steps.

* * * * *